US007210245B1

(12) United States Patent
Galli

(10) Patent No.: US 7,210,245 B1
(45) Date of Patent: May 1, 2007

(54) FOOTBALL WARMING AND DRYING DEVICE

(76) Inventor: Victor Galli, 4405 Mira Loma Dr., Pittsburg, CA (US) 94565

( * ) Notice: Subject to any disclaimer, the term of this patent is extended or adjusted under 35 U.S.C. 154(b) by 29 days.

(21) Appl. No.: 11/293,730

(22) Filed: Dec. 5, 2005

(51) Int. Cl.
*F26B 11/02* (2006.01)

(52) U.S. Cl. ..... 34/201

(58) Field of Classification Search ..... 34/201, 34/490; 206/315.9; 454/370; 211/9
See application file for complete search history.

(56) References Cited

U.S. PATENT DOCUMENTS 3,152,875 A * 10/1964 Davis, Jr. et al. ..... 34/104
3,686,774 A * 8/1972 Beadle, Jr. ..... 34/104
3,747,226 A * 7/1973 Graffius ..... 34/104
4,026,310 A * 5/1977 Beauregard ..... 134/86
4,055,002 A * 10/1977 Roberts et al. ..... 34/104
4,137,040 A * 1/1979 Starkey et al. ..... 432/128
2001/0037583 A1* 11/2001 Stuckey ..... 34/201
2003/0136021 A1* 7/2003 Pesnell ..... 34/595

* cited by examiner

*Primary Examiner*—S. Gravini

(57) ABSTRACT

Football warming and drying device with a housing, a propane powered heat source, the housing including a plurality of drawers for gaining football access, the housing also including a battery powered fan affixed to one wall, the fan wall including apertures to allow air flow from the fan into the housing, a wall opposite to the fan wall that includes an adjustable vent door to allow excess heat to escape from the housing, each drawer having a shelf, each shelf capable of being slid out of the housing, each shelf including a plurality of football holding rings that allow each football to be stored in a vertical position. The remainder of the shelf includes open spaces to allow easy passage of heat from one level to another.

2 Claims, 5 Drawing Sheets

FOOTBALL WARMING AND DRYING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sports accessories and more specifically to a football warming and drying device.

The game of football is well known in the United States. It is played with an elliptical shaped ball that is pointed at each end. The ball is inflated with air and the outer skin can be made of pig skin or man made elastomeric materials that are molded to simulate pig skin. The game of football is played in a variety of weather conditions including rain and snow. Under these conditions, the ball can become quite slippery, and in cold weather can become rock hard, making the ball difficult to throw and catch. Therefore it is desirable to use a dry, warm football whenever possible. During a typical high school or college game each team uses their own footballs when they have possession of the ball. Therefore a team that has access to a dry warm ball is at an advantage to a team that does not. To this end, the concept of a football dryer has been contemplated by a number of inventors.

U.S. Pat. No. 4,843,730 by C. Grant et al shows a method of drying footballs that uses silicon dioxide to absorb water. The user puts the ball in a bag with powder in it and shakes it. U.S. Pat. No. 4,137,040 by W. Starkey et al shows a dryer that has a carrousel for the footballs to ride in and uses a generator powered by gasoline to provide power to heaters. U.S. Pat. No. 4,055,002 by D. Roberts et al includes a pair of contoured rollers that rotate causing a friction and rubbing to wipe the ball. U.S. Pat. No. 3,747,226 by K. Graffius shows a dryer that uses electric heat lamps and needs to be plugged into 120 volts AC. Patent application 2003/013602 by A. Presnell shows a dryer that uses a 3,000 watt heater powered by a battery.

Each of the prior art has its deficiencies that will be overcome by the present invention. The Grant patent is an inherently messy operation and rather time consuming. The Roberts patent dries only one ball at a time and is a rather complicated and expensive solution. The Graffius patent is not portable. The Starkey patent is quite large and the use of a separate gasoline powered generator makes it noisy and less portable that desired to be carried in a vehicle which carries football players such as a bus or SUV. The Presnell patent application shows a large device that uses a 3,000 watt heater powered by a battery. Even a huge battery would only last about thirty minutes putting out 3,000 watts of power. The Ferris wheel design wastes a lot of space inside the housing making the entire unit difficult to transport to away games.

BRIEF SUMMARY OF THE INVENTION

The primary object of the invention is to provide a football warming and drying device that can quickly warm and dry a plurality of footballs within a portable housing that can be easily transported to a playing field.

Another object of the invention is to provide a football warming and drying device that allows easy access to the footballs being stored within said housing.

Another object of the invention is to provide a football warming and drying device that can be used on the field without need for a 120 volt AC power source.

A further object of the invention is to provide a football warming and drying device that allows even heat distribution within said housing so that all stored footballs can be warmed and dried uniformly.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed football warming and drying device comprising: a housing, a propane powered heat source, said housing including a plurality of drawers for gaining football access, said housing also including a battery powered fan affixed to one wall, said fan wall including apertures to allow air flow from said fan into said housing, a wall opposite to said fan wall that includes an adjustable vent door to allow excess heat to escape from said housing, a plurality of drawer shelves situated within said housing, each said shelf capable of being slid out of said housing, each said shelf including a plurality of football holding rings that allow each football to be stored in a vertical position, and the remainder of said shelf including open spaces to allow easy passage of heat from one level to another.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
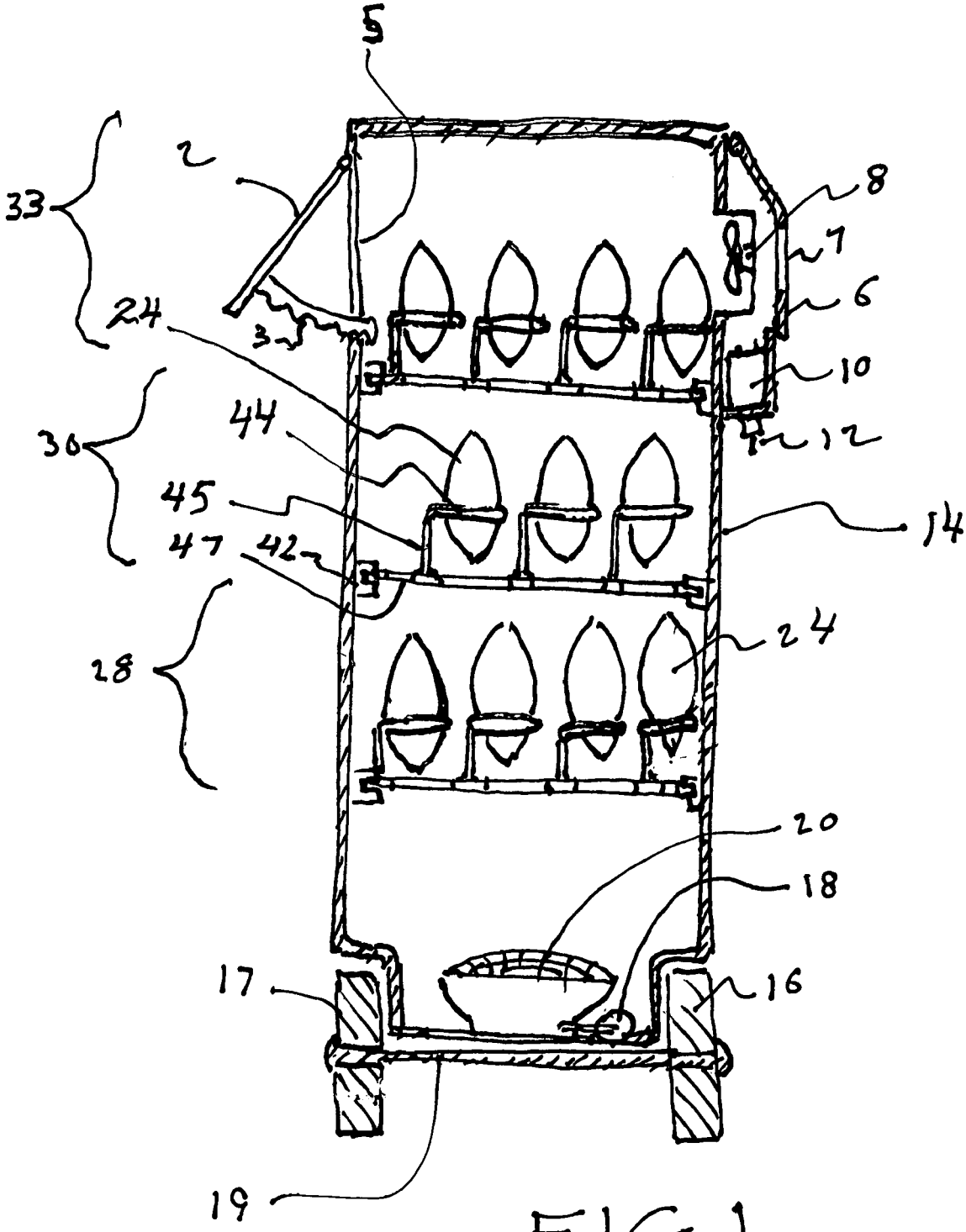
FIG. 1 is a front section view of the invention.

Referring now to FIG. 1 we see a front section view of the invention 100. The footballs 24 stored in housing 14 are held vertically in rigid rings 44. The inside diameter of the rings

Figure 2:
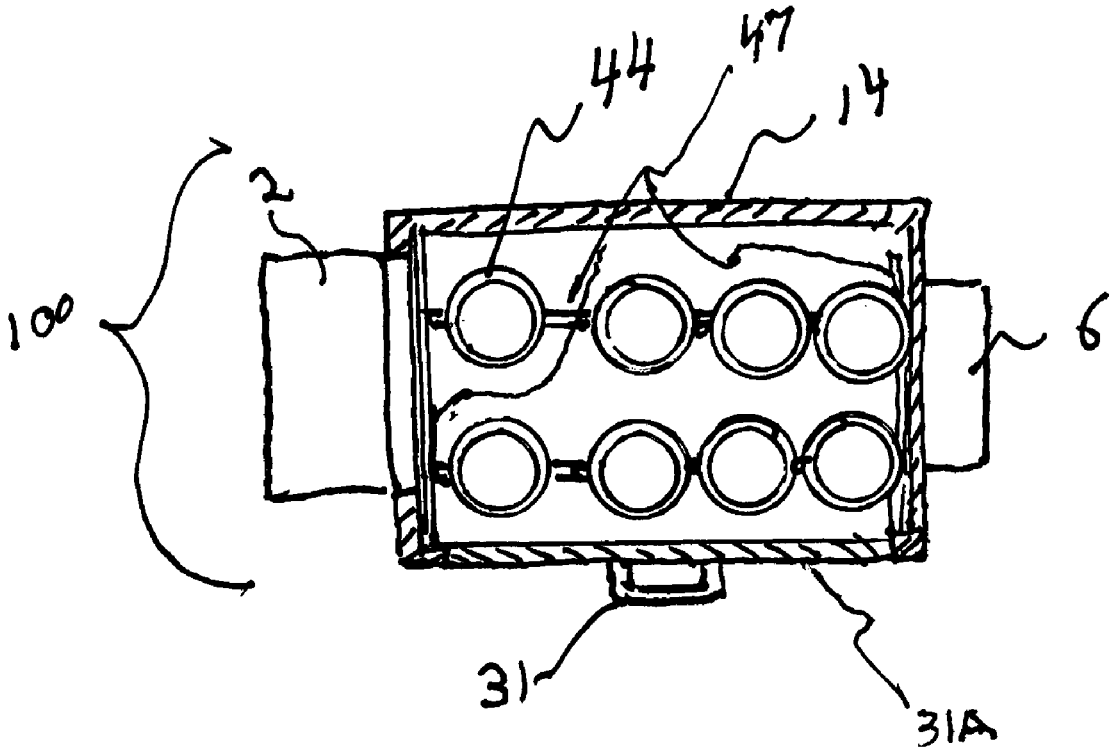
FIG. 2 is a top section view of one shelf configuration of the invention.
Figure 2A:
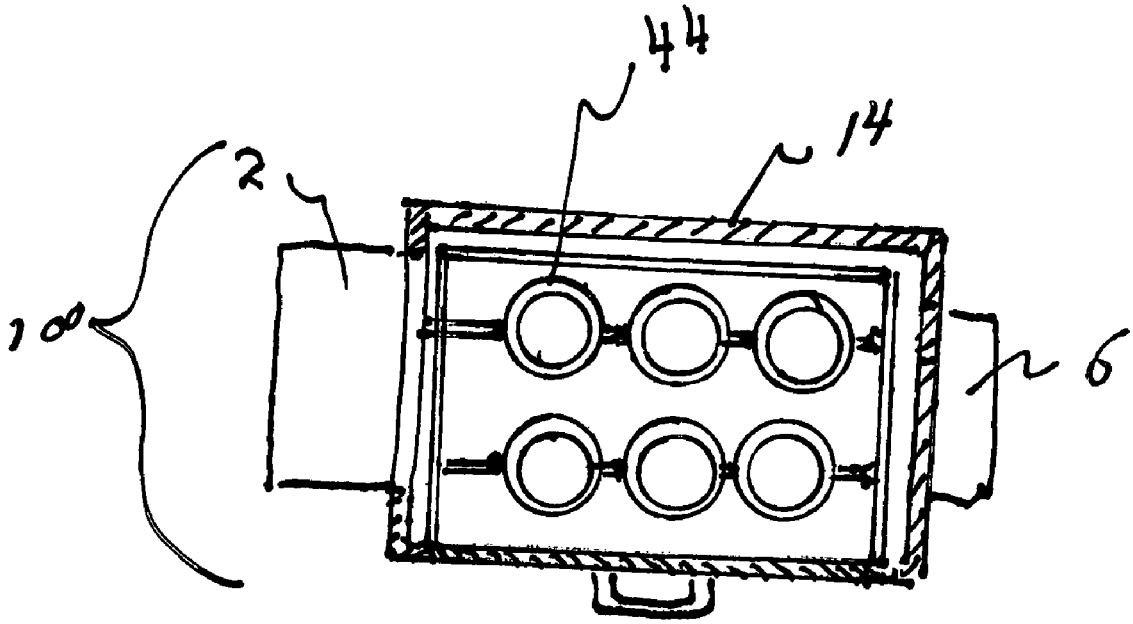
FIG. 2A is a top section view of a second shelf configuration of the invention.
Figure 3:
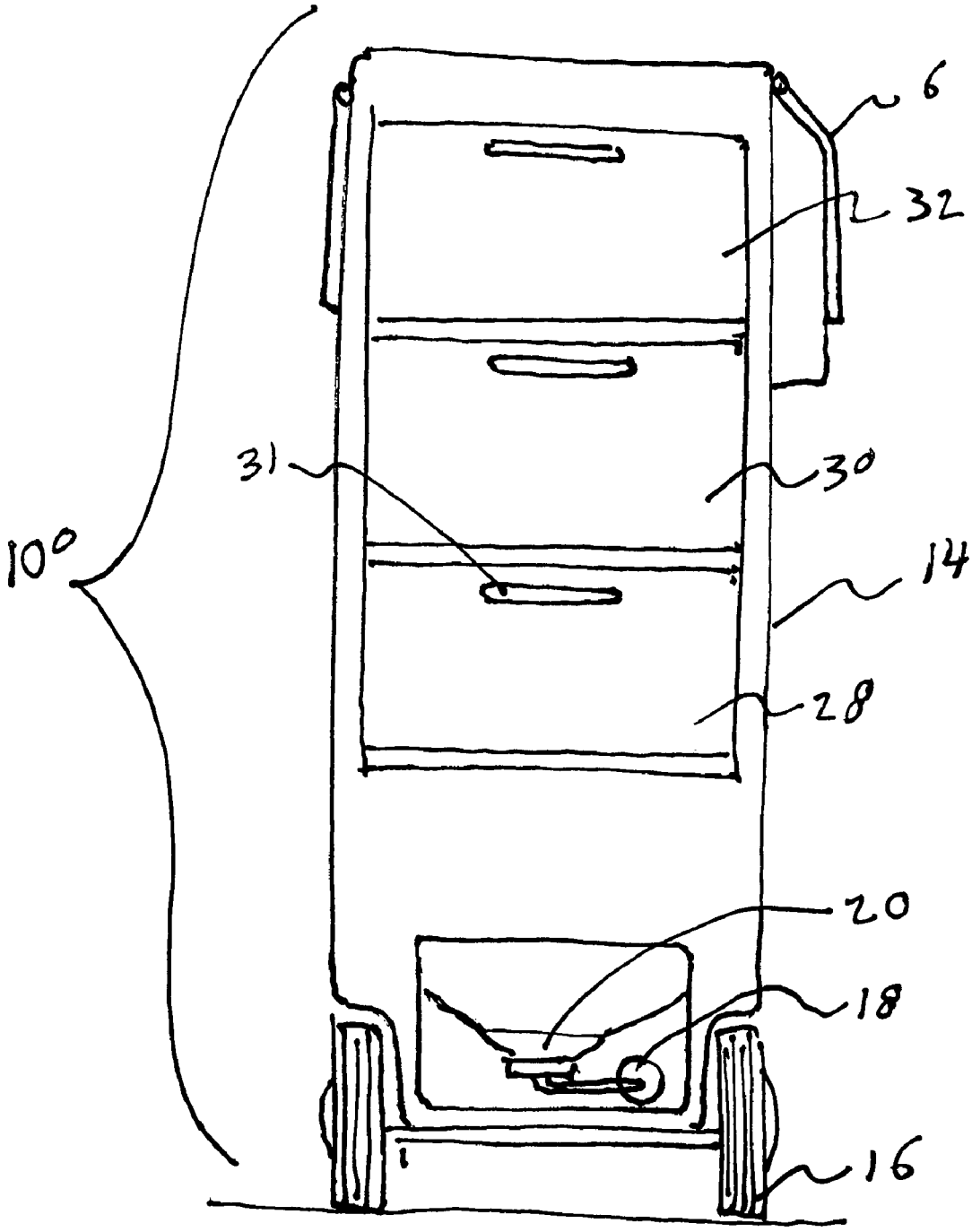
FIG. 3 is a front view of the invention.
Figure 4:
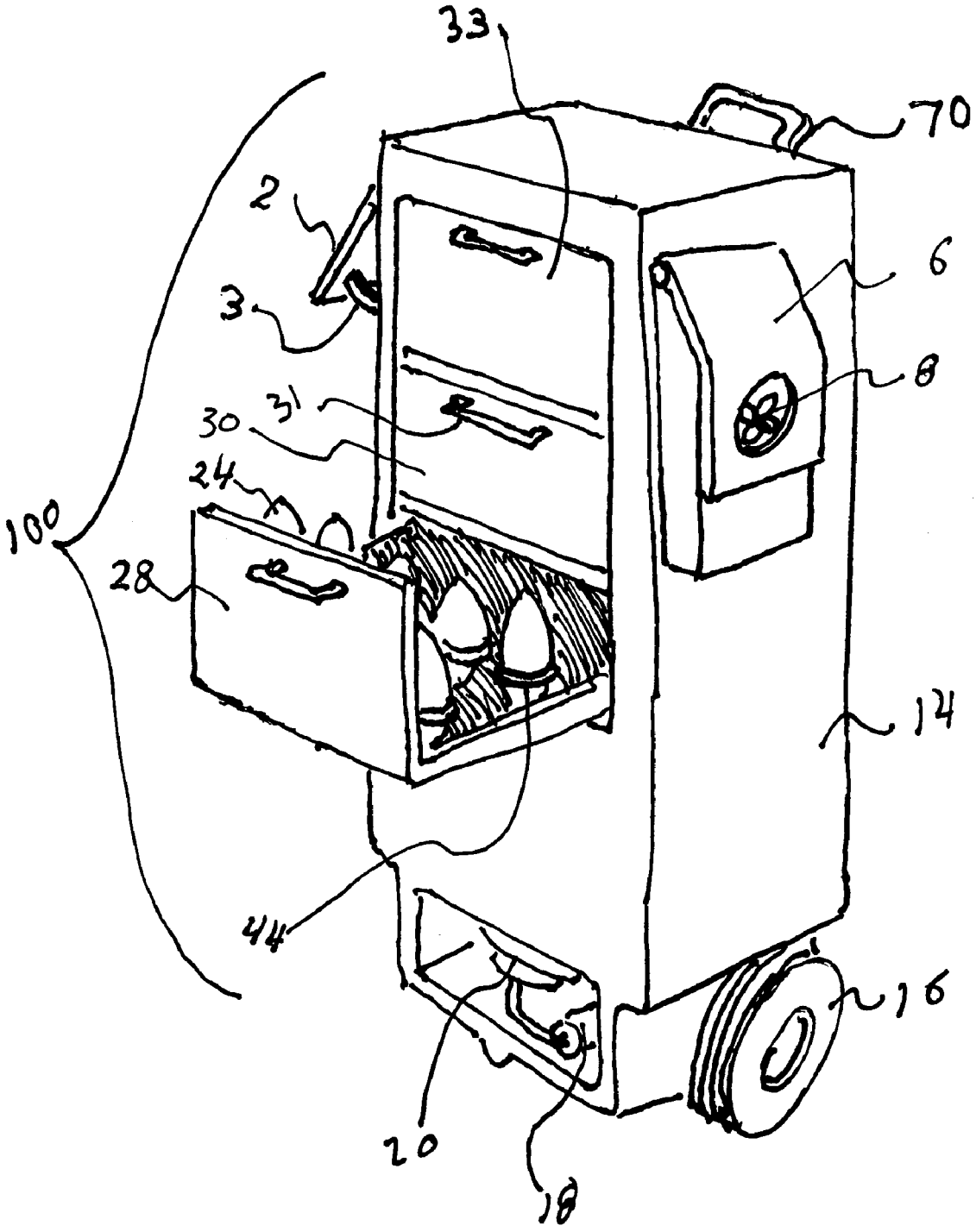
FIG. 4 is a perspective view of the invention.

44 are smaller than the widest diameter of the football so that the football 24 can be suspended by the ring 44. The rings 44 are each supported by a vertical rod 45 that is in turn attached to horizontal frame 47. The frame 47 is slidably supported by retaining members 42. In the preferred embodiment there are three drawer levels 28, 30, 33 that hold a total of twenty-two footballs. Obviously, smaller or larger units can be constructed to house more or fewer balls. The housing 14 is constructed of rigid heat resistant material such as sheet metal. The outside of housing 14 is covered with a water resistant material so it can be safely used during any type of weather including rain or snow. Propane heater 20 operates in conjunction with replaceable propane tank 18. The tank 18 is a standard 400 gram type that can be found in most hardware stores. Heater 20 is similar to model MH 12, made by Mr. Heater of Cleveland, Ohio that puts out 8,000 BTU's of heat at low setting and lasts for over three hours per tank of propane. An air space of at least twelve inches between the heater 20 and the first level of footballs 28 is needed so that the balls will not be overheated. To further control excess heat, an electric fan assembly 8 is located in housing 6 and powered by battery 10. The fan can be turned on and off by switch 12. The battery is preferably a rechargeable type where one charge can last at least three hours. An aperture 7 in front of the fan 8 allows outside air to be drawn into the housing 14. Another aperture 5 at the opposite side of housing 14 allows hot air to exit. Vent door 2 is hinged at the top and can be held open at varying degrees by space bar 3. Wheels 16, 17 are attached to axle 19. In FIG. 2 we see a top section view of the invention 100 where the holding eight rings 44 within drawers 28 and 34 can be clearly seen, as well as support frame 47. The space between the rings is empty thereby allowing warm air to pass freely to all levels 28, 30, 33. Drawer handle 31 is used to pull the frame 47 and attached front panel 31A. out from housing 14 as shown in FIG. 4. FIG. 2A shows shelf level 30 where six rings 44 are held in a similar way as to shelf levels 28 and 34 as discussed above. The six rings 44 are positioned in such a way that they allow air to freely pass from lower shelf 28 to upper shelf 33. FIG. 4 shows drawer 28 opened and footballs 24 being held upright by rings 44. The filing cabinet type configuration of the invention 100 allows the user to have easy access to all balls 24 while releasing a minimum of stored heat from the housing 14. Handle 70 allows a person to grasp the handle 70 to pull or push the unit 100 on its rolling wheels 16, 17. FIG. 5 shows a front view of the invention 100. In the preferred embodiment, the overall height of the unit 100 is 58 inches, the width is 28 inches and the depth is 18 inches. These dimensions, along with the fact that the unit can be easily transported by rolling on wheels 16, 17, make the unit 100 easy to take onto a football field or into a vehicle such as a bus or van for transport to an away game.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Football warming and drying device comprising:

a water resistant housing;

a propane powered heat source;

said housing including a plurality of drawers for gaining football access;

said housing also including a battery powered fan affixed to one wall;

said fan wall including an aperture that allows air flow from said fan into said housing;

a housing wall opposite to said fan wall that includes an adjustable vent door to allow excess heat to escape from said housing;

each said drawer capable of being slid out of said housing;

each said drawer including a shelf having a plurality of football holding rings that allow each football to be removably stored in a vertical position; and the remainder of said shelf including open spaces to allow easy passage of heat from one level to another.

2. Football warming and drying device as claimed in claim 1 further comprising a pair of wheels at the lower portion of said housing and a handle affixed to the top rear portion of said housing so that a person can pull said housing by said handle and roll said housing to a desired location.

* * * * *